United States Patent [19]

Meneely

[11] Patent Number: 4,932,372

[45] Date of Patent: Jun. 12, 1990

[54] APPARATUS AND METHOD FOR RETARDING A TURBOCHARGED ENGINE

[75] Inventor: Vincent A. Meneely, Langley, Canada

[73] Assignee: Pacific Diesel Brake Co., Surrey, Canada

[21] Appl. No.: 381,366

[22] Filed: Jul. 18, 1989

Related U.S. Application Data

[63] Continuation-in-part of Ser. No. 189,282, May 2, 1988, Pat. No. 4,848,289.

[51] Int. Cl.[5] ..... F01L 13/00

[52] U.S. Cl. ..... 123/182; 123/321; 123/559.2

[58] Field of Search ..... 123/182, 321, 559.2

[56] References Cited

U.S. PATENT DOCUMENTS 3,332,405 7/1967 Haviland ..... 123/182
4,706,624 11/1987 Meistrick et al. ..... 123/321
4,741,307 5/1988 Meneely ..... 123/321
4,763,471 8/1988 Keller ..... 123/559.2

*Primary Examiner*—Charles J. Myhre
*Assistant Examiner*—Weilun Lo
*Attorney, Agent, or Firm*—Shlesinger & Myers

[57] ABSTRACT

The invention includes an apparatus for retarding a turbocharged engine. There is a mechanism, such as a master and slave cylinder arrangement, for cracking open each exhaust valve of each cylinder of the engine near top dead center of each compression stroke. There is also provision for increasing the pressure of gases in the exhaust manifold sufficiently to open exhaust valves of other cylinders on the intake stroke after each exhaust valve on the compression stroke is so opened. The provision for increasing the pressure of gases in the exhaust manifold includes a device for diverting the exhaust gases to a restricted portion of the turbine nozzle, thereby increasing the pressure of gases directed onto the turbine blades and the pressure in the exhaust manifold.

13 Claims, 3 Drawing Sheets

APPARATUS AND METHOD FOR RETARDING A TURBOCHARGED ENGINE

RELATED APPLICATION

This is a continuation in part of application Ser. No. 07/189,282 filed May 2, 1988 now U.S. Pat. No. 4,848,289.

BACKGROUND OF THE INVENTION

The invention relates to an apparatus and method for retarding internal combustion engines, typically diesel engines, by releasing compressed gases from each cylinder through an exhaust valve near the top dead centre position of a compression stroke and at the same time, opening the exhaust valve of a cylinder on an intake stroke.

Truckers commonly encounter the problem of slowing heavy trucks, usually diesel-powered trucks, on long downgrades. It is well known that excessive use of conventional brakes leads to premature brake wear and to overheating of the brakes. Consequently, it is well known to slow trucks with diesel engines by compression release retarding devices. These devices operate by cracking open each exhaust valve just prior to top dead centre of each compression stroke with the fuel supply to the engine cut off. The compressed gases are then diverted into the exhaust manifold, instead of being retained in each cylinder, which would provide an undesirable rebound effect and cancel the braking effect of the compression stroke.

Patents have been issued for engine braking devices of this type, including the following U.S. patents assigned to Jacobs Manufacturing Company:

| | | | | |
|---|---|---|---|---|
| 4,592,319; | | 4,339,787; | 4,398,510; | 4,473,047; |
| 4,423,712; | | 4,395,884; | 4,474,006; | 4,485,780; |
| 4,510,900 | and | 4,572,114. | | |

There is also U.S. Pat. No. 4,655,178 issued to the present inventor.

My own previous U.S. Pat. No. 4,741,307, issued May 3, 1988 discloses the principle of opening an exhaust valve of a cylinder on the intake stroke while cracking open an exhaust valve near top dead centre of a compression stroke. This causes the gases from the cylinder on the compression stroke to be diverted into the cylinder on the intake stroke, thus increasing the charge received in each cylinder. When that same cylinder reaches the compression stroke, there is more charge in the cylinder, thereby increasing the braking effect as the gases are compressed. In this previous patent, hydraulic means was employed to operatively engage all of the exhaust valves of a group of cylinders, such that all of the exhaust valves of that group of cylinders are opened simultaneously. The exhaust valve of a first cylinder is cracked open when the cylinder is near top dead centre of a compression stroke, the other two cylinders being on the intake stroke and exhaust stroke respectively.

It is known to retard engines using an exhaust restrictor. Exhaust restriction in itself provides a braking effect by providing a back pressure when each cylinder is on the exhaust stroke. In any previous application, Ser. No. 07/189,292 an exhaust restrictor was used to raise pressure in the exhaust manifold sufficiently to pop open exhaust valves of cylinders on the intake stroke.

It is also known to provide an adjustable nozzle or diverter on the turbine of a turbocharged internal combustion engine equipped with a compression relief brake. The adjustable nozzle or diverter restricts the flow of exhaust gases to a limited portion of the turbine only. The purpose in doing this is typically to increase the velocity of gases entering the turbine to increase the turbine speed and thus the compressor speed when the engine being braked. This increases the volume of air drawn into the engine and therefore the compression load and braking effect. A diverter of this type is shown, for example, in Federal German patent application No. 28 20 940 Published Nov. 23, 1978. The U.S. Pat. No. 4,474,006 to Price issued Oct. 2, 1984 discloses the use of a diverter valve to divert the exhaust gases to one portion of the divided volute of the turbine. U.S. Pat. No. 4,395,884 to Price issued Aug. 2, 1983 discloses the use of a diverter valve to divert all of the flow of the exhaust gases into one portion of a double entry turbine. These previous patents do not disclose an adjustable nozzle or diverter which provides sufficient pressure in the exhaust manifold to achieve the opening of exhaust valves for cylinders on the intake stroke and thus derive benefits similar to those of my earlier invention in U.S. Pat. No. 4,741,307.

SUMMARY OF THE INVENTION

One aspect of the invention provides a method for retarding a turbocharged engine including the steps of opening a first exhaust valve of a first cylinder of the engine near top dead centre of each compression stroke of the first cylinder, and increasing the pressure of gases in the exhaust manifold sufficiently to open a second exhaust valve of a second cylinder of the engine on each intake stroke of the second cylinder after the first exhaust valve so opens. The manifold pressure is increased by diverting the exhaust gases to a restricted portion of the turbine only, thereby increasing the pressure of exhaust gases acting on the turbine and in the exhaust manifold.

A second aspect of the invention provides an apparatus for retarding a turbocharged multi-cylinder, four-stroke engine having intake valves and exhaust valves, the exhaust valves communicating with a common exhaust manifold. The apparatus includes means for opening a first exhaust valve of a first cylinder of the engine near top dead centre of each compression stroke of the first cylinder. There is also means for increasing the pressure of gases in the exhaust manifold sufficiently to open a second exhaust valve of a second cylinder on each intake stroke of the second cylinder after the first exhaust valve is so opened. The means for increasing includes means for diverting the exhaust gases to a restricted portion of the turbine only, thereby increasing the pressure of exhaust gases acting on the turbine and in the exhaust manifold.

Further retarding of the compression relief brake may also be necessary to achieve the opening of exhaust valves of cylinders on the intake stroke. The present invention can considerably increase the braking horsepower achieved by a compression release-type engine braking device. The invention can achieve this desirable object by diverting exhaust gases from the exhaust manifold into cylinders on the intake stroke to increase the charge of each cylinder prior to compression. The longer the cracking open of the first exhaust valve is delayed, the greater the pressure of gases compressed within the cylinder, and thus the greater the pressure Pulse generated in the exhaust manifold when the valve is cracked open. The apparatus is adjusted so the pressure of this pulse, when added to the higher pressure in the exhaust manifold caused by the diverting of exhaust gases to the restricted portion of the turbine, is sufficient to open the second exhaust valves. It will be realized that only the valve spring maintains a valve closed when the cylinder is on the intake stroke. There is a negative pressure within the cylinder due to the downward motion of the piston which tends to open the valve. Thus the exhaust valve can be opened against the closing force of the valve spring if there is a sufficient pressure within the exhaust manifold acting on the exhaust valve.

DESCRIPTION OF THE PREFERRED EMBODIMENTS

Figure 1:
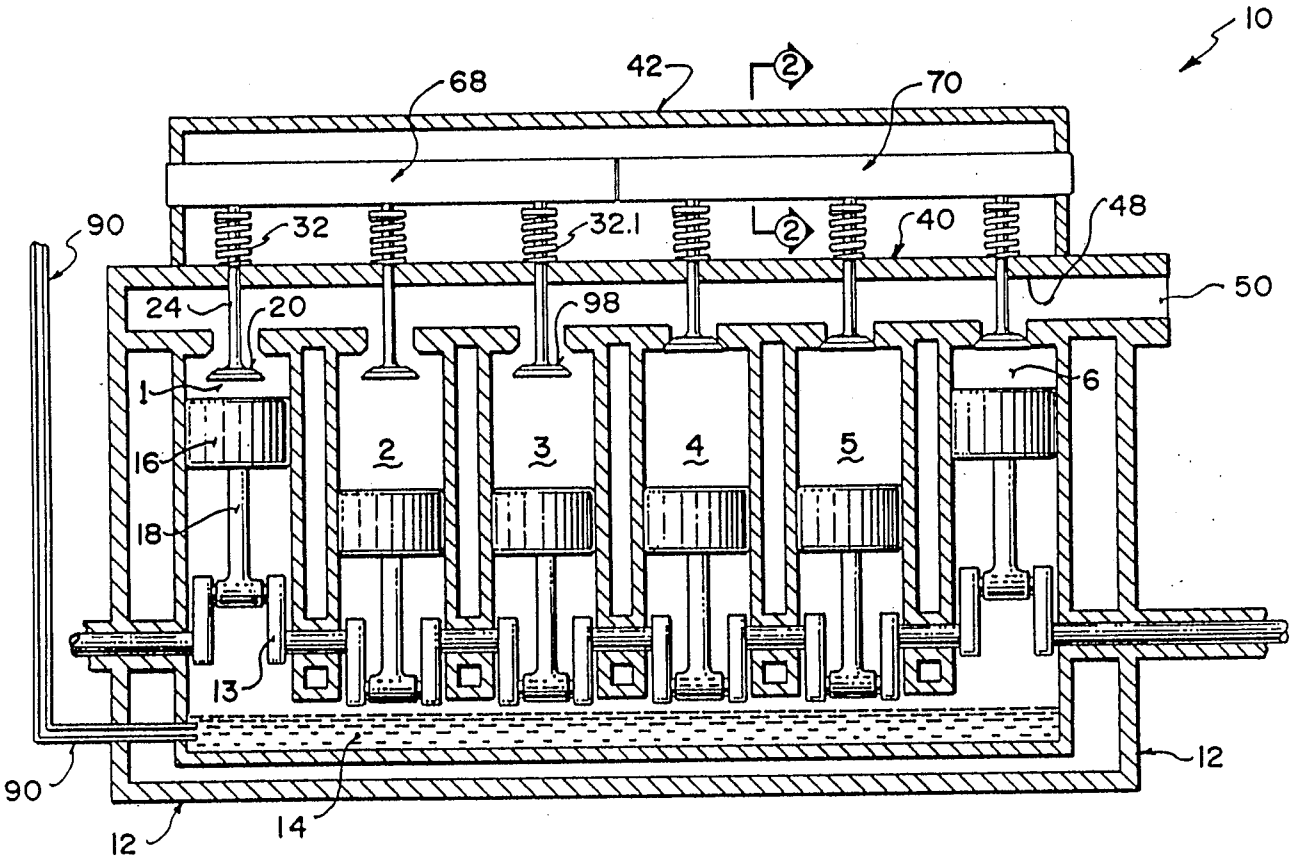
FIG. 1 is a partly diagrammatic and simplified longitudinal, sectional view of a diesel engine fitted with a compression release retarding device.

Referring to the drawings, FIG. 1 shows a conventional diesel engine 10, having a block 12 with a crankshaft 13 located in crankcase 14. The engine has a plurality of pistons, one for each cylinder, such as piston 16 of cylinder 1. The pistons are connected to the crankshaft in the conventional manner by connecting rods such as connecting rod 18.

Each cylinder is provided with exhaust valves and intake valves The intake valves are not shown in FIG. 1, and only one exhaust valve is shown for each cylinder, such as valve 20 of cylinder 1. Each of the cylinders, as with many diesel engines used in heavy trucks, may have a pair of exhaust valves and cylinder 1 has a second exhaust valve 22 shown in FIG. 2. The two exhaust valves 20 and 22 have valve stems 24 and 26 and valve springs 32 and 33. The conventional valve opening mechanism includes a crosshead 28, with a depending tube 30 extending downwardly therefrom. This structure is not shown in FIG. 1. In the conventional manner, the valves are a rocker arm 34 presses downwardly on crosshead 28 to open both exhaust valves when required.

Figure 2:
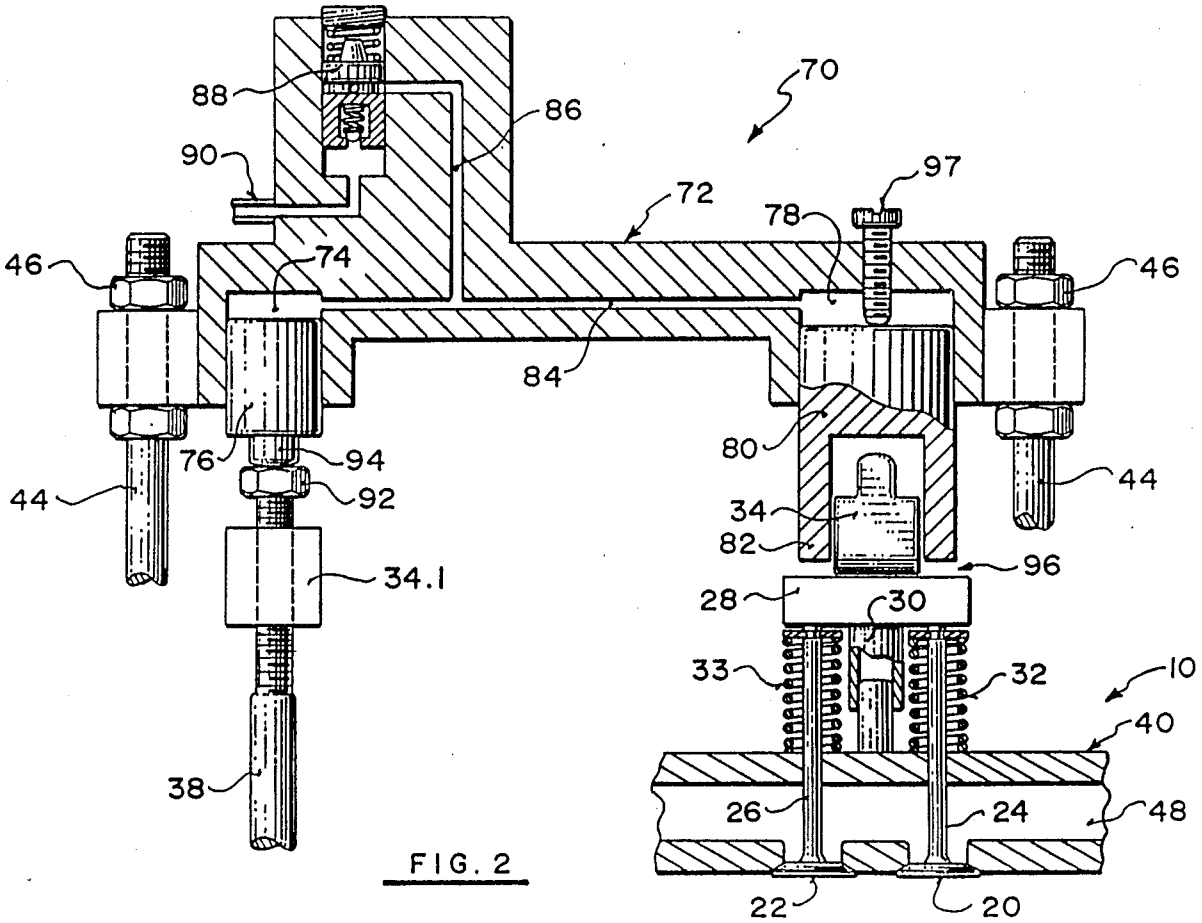
FIG. 2 is a partly diagrammatic, sectional view of a compression release retarding device taken along line 2—2 of FIG. 1 and showing fragments of the engine.

The rocker arm is activated by a push tube, such as push tube 38 shown for another rocker arm 34.1 in FIG. 2. The push tube is received in a cam follower which acts on a camshaft, not shown in the drawings. This is conventional for such engines. The camshaft rotates and lifts the push tube at the appropriate time to depress the opposite end of the rocker arm and open the exhaust valves.

Figure 3:
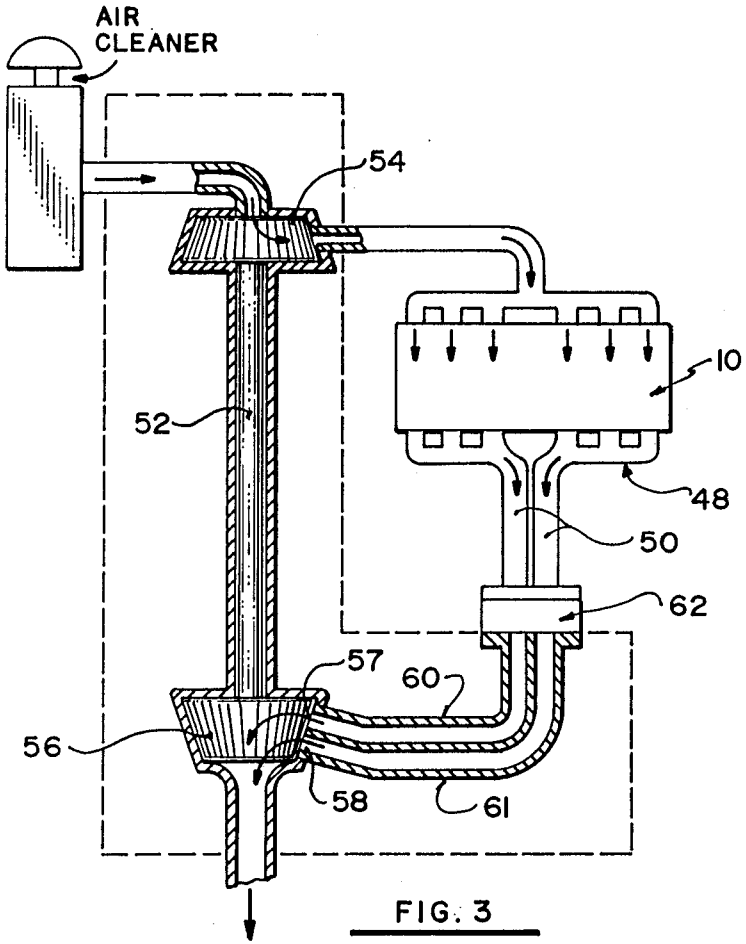
FIG. 3 is a diagrammatic view of the engine of FIG. 1 in combination with a turbocharger including a split entry turbine.

Referring back to FIG. 1, the engine 10 has a cylinder head 40. The engine has six cylinders numbered 1, 2, 3, 4, 5 and 6 in the conventional manner. It also has a conventional exhaust manifold 48 which is in two parts, front and rear in this example as shown in FIG. 3. This allows exhaust gases released from the cylinders to leave the engine through exhaust outlet 50.

Engine 10 is also with a pair of compression release retarding devices 68 and 70. These devices are generally conventional and are, in principle, the same as each other. Device 68 is used for cylinders 1–3, and device 70 is used for cylinders 4–6. The devices are interposed between cylinder head 40 and valve cover 42 in the previously known manner and are held in place by the bolts 44 and nuts 46 as shown in FIG. 2 for device 70.

Both devices 68 and 70 include a body 72 and shown for device 70 in FIG. 2. This body is a casting in the preferred embodiment as illustrated. The body is adapted in this case for half the cylinders of a six cylinder engine in this instance and includes three master cylinders, such as master cylinder 74 as shown in FIG. 2. Each master cylinder has a master piston 76 slideably received therein. The body 72 also has three slave cylinders, such as slave cylinder 78. There is one slave cylinder for the exhaust valves of each of the cylinders for which the device used. In this case, slave cylinder 78 has a slave piston 80 with a bifurcated lower portion 82 which operatively contacts exhaust valves 20 and 22 of cylinder 1 by means of crosshead 28. The slave cylinder 78 is hydraulically connected to master cylinder 74 by means of an hydraulic fluid conduit 84. The hydraulic fluid employed is engine oil received from conduit 86 which extends to a spool valve 88. Valve 88 in turn is connected to another hydraulic conduit 90 which extends through an electric solenoid valve (not shown) to the bottom of crankcase 14 as shown in FIG. 1.

In such devices, each master piston is positioned to operatively contact a push tube of the engine and has an associated slave piston which operatively contacts one or more exhaust valves. The particular push tube is chosen such that the slave piston will be depressed downwardly just before top dead centre on the compression stroke of its cylinder. In the illustrated example, master piston 74 is positioned over push tube 38 which contacts rocker arm 34.1 for the exhaust valve of cylinder 2 shown in FIG. 1. Of course, the particular push tube chosen depends upon the configuration of the engine involved. In this case, push tube 38 has been selected because it is actuated at the proper time, that is prior to top dead centre of cylinder 1 on its compression stroke. In other engines, a different push tube, or possibly some other engine component is employed. As is known, in alternative embodiments electronic control or a pulse generator may be used to control actuation of each of the master cylinders. In the present case, however, where push tubes are used, a hardened adjustment screw 92 threadedly received on rocker arm 34.1 is positioned to contact a projection 94 on the bottom of the master piston 76.

There is a gap 96 between the slave piston and crosshead 28 when the slave piston is retracted as seen in FIG. 2. A gap is conventionally employed on such devices for timing purposes. There is rarely, if ever, a push tube which lifts at the exact time to crack open each exhaust valve just prior to top dead centre of the compression stroke. It is clearly impossible to utilize a push tube which lifts too late, so conventionally push tubes are employed which in fact begin lifting before cracking open of valves 20 and 22 is desired.

It has been recognized that it is desirable to crack open valves 20 and 22 as close as possible to top dead centre of the compression stroke because the braking effect increases greatly as the piston approaches top dead centre of the compression stroke. The pressure within the cylinder rises considerably towards the end of the stroke and thus, if the exhaust valves are cracked open too early, considerable braking force is lost. At the same time, the exhaust valves must open sufficiently before the top dead centre position such that the compressed gases in the cylinder are completely released before the subsequent expansion stroke begins. If not, the compressed gases remaining within the cylinder have an undesired rebound effect on the piston which diminishes the braking effect.

The timing of cracking open of the exhaust valves in the embodiment of FIG. 2, is, as stated above, governed by the amount of gap 96 provided between the slave piston and the crosshead 28. The size of the gap is adjusted by rotation of adjustment screw 97. The screw limits upward movement of slave piston 80 and thus the amount of gap 96. It is adjusted so the slave piston contacts the crosshead just as the cracking open of the exhaust valve is desired.

As is known in such devices, the solenoid valve referred to above is controlled by a switch within the cab of the vehicle to supply oil to conduit 90 when compression release retarding is desired, typically on a downgrade. Thus, when master piston 76 is raised by push tube 38 acting through rocker arm 34.1 and adjustment screw 92, the hydraulic system comprising the master cylinder 74, conduits 84 and 86 and master cylinder 78 is closed by spool valve 88. Therefore, the lifting of the master piston 76 must be accommodated by downward movement of slave piston 80. The lower end 82 of the slave piston pushes on crosshead 28, thus opening the valves 20 and 22.

Referring to FIG. 3, the engine 10 is provided with a conventional turbocharger 52 having a compressor 54 coupled to a turbine 56. The turbine is driven by exhaust gases entering the turbine through twin nozzles 57 and 58. Exhaust gases reach the nozzles 57 and 58 through conduits 60 and 61 respectively which are coupled to exhaust outlet 50 and exhaust manifold 48 through a gas diverter valve 62. The arrangement is generally the same as in U.S. Pat. No. 4,395,884. The valve includes two butterfly valves. The first butterfly valve is positioned above conduit 60 to close off the conduit when closed, and open the conduit when open. The second butterfly valve is positioned between the two conduits and has a open, vertical position so all exhaust gases are diverted into conduit 61 when the first butterfly valve is closed. The second butterfly valve has a closed position at an acute angle when the first butterfly valve is open to divert exhaust gases into both conduits 60 and 61. Thus, the diverter valve can selectively divert exhaust gases to both nozzles 57 and 58 or to nozzle 58 only. The nozzle 58 would be smaller than dictated by the prior art to raise the pressure of gases entering the turbine and in the exhaust manifold sufficiently to open exhaust valves which are normally closed on the intake stroke of their respective cylinders as detailed below. Additional retarding of the engine brake timing may also be required.

Figure 4:
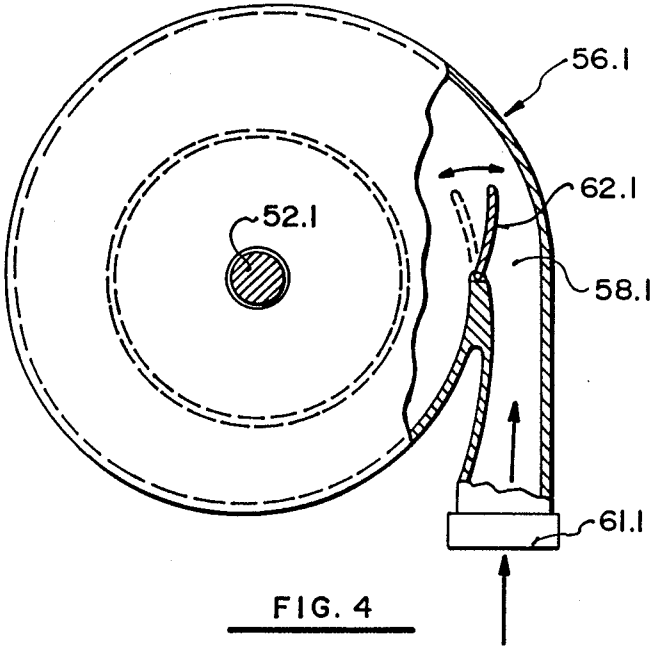
FIG. 4 is a top view, partly broken away, of an alternative turbine provided with a diverter valve for the engine of FIG. 1.

Referring to FIG. 4, this shows an alternative turbine 56.1 to replace the turbine 56 shown in FIG. 3. This turbine is of the type shown, for example, in Federal German Offenlegungsschrift No. 28 20 941 published Nov. 23, 1978. In turbine 56.1 diverter 62.1 is the form of an adjustable nozzle having a flap pivotally mounted for movement as indicated by the arrows. The diverter can be moved to the position shown in solid lines to divert all the exhaust gases to the outer portion of the turbine only, thereby increasing the pressure of exhaust gases and consequently the pressure in the exhaust manifold. Only a single conduit 61.1 is connected to the exhaust manifold in this instance. Shaft 52.1 of the turbine is connected to a compressor similar to that in FIG. 3. FIGS. 3 and 4 show only examples of types of turbines that may be utilized. Other types of turbines with adjustable nozzles can be utilized in a manner such that the nozzle size is effectively reduced when the exhaust brake is in operation, thus increasing the back pressure in the manifold to the degree required. The invention, unlike the prior art, increases the back pressure sufficiently such that the exhaust gas pressure in the exhaust manifold opens exhaust valves of cylinders on the intake stroke when exhaust valves of cylinders on the compression stroke are cracked open near top dead centre. To achieve this effect, it may be necessary to retard the cracking open of the valves for cylinders on the compression stroke longer than usual.

The compression release retarding devices 68 and 70 are employed in the conventional manner to crack open the exhaust valves of each cylinder just before top dead centre of the compression stroke to remove the rebound effect of the compressed gases in each cylinder. As is shown in FIG. 1, exhaust valve 20 of cylinder 1 has been cracked open by device 68. When the valve is so cracked open, a high pressure pulse propagates through the manifold 48 because the pressure of gases released from cylinder 1 is higher than the normal pressure in the manifold. However, the pressure thus created in the manifold is not conventionally high enough to create the desired effect. According to the invention, the exhaust gas diverter 62 or 62.1 is employed as means for increasing the pressure of gases in the exhaust manifold prior to cracking open of each set of exhaust valves near top dead centre of the compression stroke. In addition, the gap 96 shown in FIG. 2 may be increased to delay cracking open of these valves so that the pressure pulse Propagated through the manifold, when added to the background pressure in the manifold already created by the exhaust gas diverter, is sufficiently high to pop open the exhaust valves for the cylinders on the intake stroke. Thus there is a synergistic effect achieved by combining the compression release retarder and the gas diverter not achieved by either element alone.

Of course, the exact pressure required in the exhaust manifold depends upon the configuration of the particular engine including the compression force of the springs of the exhaust valves and the size of the exhaust valves. Likewise, the means for cracking open the exhaust valves of the cylinders on the intake stroke can be varied even for the same engine. Whatever the means, the instantaneous pressure in the exhaust manifold must be sufficient to pop open the exhaust valves of the cylinders on the intake stroke. For example, exhaust valve 98 of cylinder 3 is shown in FIG. 1 just after the compressed gases are released from exhaust valve 20 of cylinder 1 which is near top dead centre of the compression stroke. In this manner, the compressed gases released from cylinder 1 are to some extent diverted into cylinder 3 to increase the charge of cylinder 3, and therefore the braking force on the subsequent compression stroke of cylinder 3. If the pressure pulse created in the manifold by the cracking open of valve 20 is increased by retarding the opening of the valve as discussed above, then less pressure increase needs to be achieved by the exhaust diverter 62. Likewise, if the pressure in the manifold is increased more by diverter 62, then less retarding of the cracking open of valve 20 is required.

While the required pressure may be derived from various combinations of exhaust gas restriction and retarding of the cracking open of exhaust valves near top dead centre of the compression stroke, there are practical limitations for any particular engine. For example, as mentioned above, the maximum pressure pulse created by the cracking open of the exhaust valves near top dead centre of the compression stroke is limited by the need to completely purge each cylinder prior to commencement of the expansion stroke.

By way of example only, a Caterpiller diesel engine may be modified according to the invention by providing a pressure in the exhaust manifold of 50 p.s.i. utilising diverter 62 or 62.1. Conventionally the Pressure is approximately 10 to 15 p.s.i. with a turbocharger. The timing for the cracking open of valve 20, as with all of the valves prior to top dead centre of the compression stroke, is in one example prior to modification, achieved by having gap 96 of 0.070". According to the invention, the gap may be increased to 0.100", thus further retarding the cracking open of the exhaust valves prior to top dead centre of the compression stroke. With this particular combination, a substantial increase in the braking horsepower may be achieved.

As is discussed above, when the exhaust valves, such as valve 98 of FIG. 1, are cracked open on the intake stroke, pressurized exhaust gases enter the cylinders through the open exhaust valves. The valves subsequently close when the pressure drops, trapping the exhaust gases in the cylinder. The cylinder then begins the compression stroke with an increased charge, and the braking effect is increased due to the greater amount of gases in the cylinder compressed on the subsequent compression stroke.

Normal operation of the engine is resumed by means of the previously mentioned switch in the truck cab which activates the solenoid of valve 88 to move the valve spool and thus allow oil to travel through conduits 86 and 90 back to the crankcase when the master pistons are raised. The exhaust gas diverter 62 or 62.1 are returned to their normal position so exhaust gases flow to the entire turbine and fuel is again supplied to the engine.

Changes and modifications in the specifically described embodiments can be carried out without departing from the scope of the invention which is intended to be limited only by the scope of the appended claims.

What is claimed is:

1. A method for retarding an engine which is provided with a compression release brake and is turbocharged by an exhaust driven turbine, comprising the steps of:

opening exhaust valves of each cylinder of the engine near top dead centre on each compression stroke; and increasing the pressure of gases in the exhaust manifold sufficiently to open the exhaust valves of cylinders of the engine on each intake stroke during ion of the compression release brake by diverting the exhaust gases to a restricted portion of the turbine only, thereby increasing the pressure of exhaust gases acting on the turbine and in the exhaust manifold.

2. A method as claimed in claim 1, wherein each exhaust valve of cylinders on the intake stroke is opened while an exhaust valve of a cylinder on the compression stroke is open.

3. A method as claimed in claim 1, wherein the pressure of exhaust gases is further increased by retarding the opening of each exhaust valve on each compression stroke.

4. An apparatus for retarding a multi-cylinder, turbocharged four stroke engine having a compression release brake, intake valves, exhaust valves communicating with a common exhaust manifold, and an exhaust-powered turbine, the apparatus comprising:

means for opening exhaust valves near top dead center on each compression stroke; and means for increasing the pressure of gases in the exhaust manifold sufficiently to open said exhaust valves on each intake stroke during operation of the compression release brake, the means for increasing pressure including means for diverting the exhaust gases to a restricted portion of the turbine only, thereby increasing the pressure of exhaust gases acting on the turbine and in the exhaust manifold.

5. An apparatus as claimed in claim 4, wherein the means for restricting includes a diverter valve.

6. An apparatus as claimed in claim 5, wherein the turbine is a double entry turbine, the diverter valve being positioned to divert all exhaust gases into one portion of the turbine.

7. An apparatus as claimed in claim 4, wherein the means for increasing pressure includes means for retarding the opening of the exhaust valves on each compression stroke.

8. An apparatus as claimed in claim 4, wherein the means for diverting including an adjustable nozzle for the turbine.

9. In combination:

a multi-cylinder, four stroke internal combustion engine being turbocharged with an exhaust-driven turbine, and having intake valves and exhaust valves communicating with a common exhaust manifold; and an apparatus for retarding the engine including means for opening the exhaust valves near top dead center on each compression stroke; and means for increasing the pressure of gases in the exhaust manifold sufficiently to open the exhaust valves on the intake stroke after the exhaust valves are opened on each compression stroke, the means for increasing including means for diverting the exhaust gases to a restricted portion of the turbine only, thereby increasing the pressure of exhaust gases acting on the turbine and in the exhaust manifold.

10. A combination as claimed in claim 9, wherein the means for diverting includes a valve.

11. A combination as claimed in claim 9, wherein the means for increasing further includes means for retarding opening of said each exhaust valve near top dead centre of said each compression stroke to increase the pressure of gases released from the first cylinder.

12. A combination as claimed in claim 11, wherein the valves are operated by push tubes, the means for opening each said exhaust valve including a slave cylinder having a slave piston operatively contacting said each exhaust valve, a master cylinder having a master piston for operatively contacting one said push tube, and an hydraulic conduit between the master cylinder and the slave cylinder, the means for retarding including an a gap between the one push tube and the master piston prior to operation of the master cylinder by the one push tube.

13. A combination as claimed in claim 9, wherein the means for diverting includes an adjustable nozzle for the turbine.

* * * * *

UNITED STATES PATENT AND TRADEMARK OFFICE

CERTIFICATE OF CORRECTION

PATENT NO. : 4,932,372

DATED : June 12, 1990

INVENTOR(S) : VINCENT A. MENEELY

It is certified that error appears in the above-identified patent and that said Letters Patent is hereby corrected as shown below:

Claim 1, column 7, line 59, please cancel "ion" and insert --operation-- therefor.

Signed and Sealed this

Twenty-fourth Day of January, 1995

*Attest:*

Bruce Lehman

BRUCE LEHMAN

*Attesting Officer*

*Commissioner of Patents and Trademarks*